US007255620B1

(12) United States Patent
Shepherd et al.

(10) Patent No.: US 7,255,620 B1
(45) Date of Patent: Aug. 14, 2007

(54) CHILD CARRIER AND SWIMMING AID

(76) Inventors: Amy Shepherd, 730 Bunkers Cove Rd., Panama City, FL (US) 32401; Scott Smith, 730 Bunkers Cove Rd., Panama City, FL (US) 32401

( * ) Notice: Subject to any disclaimer, the term of this patent is extended or adjusted under 35 U.S.C. 154(b) by 0 days.

(21) Appl. No.: 10/955,097

(22) Filed: Sep. 30, 2004

(51) Int. Cl.
*B63C 9/08* (2006.01)
*B63C 9/11* (2006.01)
*A62B 35/00* (2006.01)

(52) U.S. Cl. ..... 441/88; 441/106; 224/160

(58) Field of Classification Search ..... 441/88, 441/102–121, 84; D21/803–805; 434/254; 224/158–161; 119/770, 857, 907
See application file for complete search history.

(56) References Cited

U.S. PATENT DOCUMENTS

| | | | | | |
|---|---|---|---|---|---|
| 1,639,607 | A | | 8/1927 | Henry | |
| 1,748,170 | A | | 2/1930 | Chesnut | |
| 2,051,231 | A | | 8/1936 | Webber | |
| 2,075,374 | A | | 3/1937 | Zucker | |
| D110,540 | S | | 7/1938 | Grunt et al. | |
| 2,124,062 | A | | 7/1938 | Grunt et al. | |
| 2,562,080 | A | | 7/1951 | Barnes | |
| 2,724,843 | A | | 11/1955 | Kinoul | |
| 4,047,255 | A | * | 9/1977 | Kiefer | 441/110 |
| 4,194,257 | A | * | 3/1980 | Martin et al. | 441/115 |
| 4,308,629 | A | * | 1/1982 | Freemon | 441/111 |
| 4,467,945 | A | | 8/1984 | Schaapveld | |
| 4,551,108 | A | * | 11/1985 | Bass | 482/69 |
| 4,552,540 | A | * | 11/1985 | Bass | 441/129 |
| 4,666,017 | A | | 5/1987 | Zimmerman | |
| 4,667,624 | A | | 5/1987 | Smith | |
| 4,799,910 | A | | 1/1989 | Kellough | |
| 4,840,591 | A | * | 6/1989 | Dulin et al. | 441/106 |
| 4,863,409 | A | * | 9/1989 | Johnson et al. | 441/80 |
| 4,903,873 | A | | 2/1990 | Poole et al. | |
| 4,973,277 | A | * | 11/1990 | Khanamirian | 441/88 |
| 4,981,110 | A | | 1/1991 | Llewellyn | |
| 5,069,168 | A | | 12/1991 | Roberson et al. | |
| 5,289,959 | A | | 3/1994 | Beeley et al. | |
| 5,766,052 | A | | 6/1998 | Metro et al. | |
| 5,766,114 | A | | 6/1998 | Campbell | |
| 5,855,497 | A | | 1/1999 | French | |
| 6,126,504 | A | | 10/2000 | Day | |
| D469,494 | S | | 1/2003 | Arias | |
| D471,614 | S | | 3/2003 | Arias | |
| 6,645,027 | B2 | * | 11/2003 | Miller | 441/88 |
| 7,037,155 | B2 | * | 5/2006 | Freeman et al. | 441/106 |
| 2004/0203302 | A1 | * | 10/2004 | Freeman et al. | 441/106 |

FOREIGN PATENT DOCUMENTS

JP 2004168231 A * 6/2004

* cited by examiner

*Primary Examiner*—Ajay Vasudeva
(74) *Attorney, Agent, or Firm*—Peter Loffler

(57) ABSTRACT

A child carrier and swimming aid allows a caregiver to carry a child in pressing relation to the caregiver's torso and allows the device to be used in the water. The adult dons a harness and places the child into a vest, which vest is a personal flotation device. The vest is attached to the harness in order to facilitate normal carrying of the child by the adult. In a body of water, the vest can be detached from the harness allowing the child to float free of the adult, with the vest being tethered to the harness for safety.

2 Claims, 3 Drawing Sheets

CHILD CARRIER AND SWIMMING AID

BACKGROUND OF THE INVENTION

1. Field of the Invention

The present invention relates to a child carrier wherein the child is carried proximate an adult's torso area and wherein the child holder doubles as a personal flotation device.

2. Background of the Prior Art

Child carriers, wherein the child is held within a carrier that is attached to a harness worn by an adult such that the child is carried proximate the adult's torso region, are used and loved by millions of moms and dads. These devices allow the caregiver to be able to hold the child using the caregiver's body to support the child instead of predominately the arms and shoulders. These carriers hold the child securely and in a pressing relation with the adult while allowing the adult to have arms and hands free for other activities such as shopping or attending to other chores such as banking. If a child is simply being carried, then when the adult desires to perform an act such as cashing a check, the adult must either place the child on the ground and struggle to make sure that the child does not run off or otherwise get into trouble (as children are famous for), or, if the child is too small, the adult must awkwardly fumble around with one hand while holding the child with the other. This is not only uncomfortable and time-consuming, but gives the caregiver a lessened sense of security in the hold on the child. Additionally, some functions require the use of both hands to perform, which functions the adult must forego should the child need to be constantly held.

The present day child carriers, which come in a variety of styles, give the caregiver both security in the knowledge that the child is being securely held and freedom to do activities that would be difficult, if not impossible, if the child were simply being free carried. These devices also give the caregiver a more intimate interaction with the child then can be experienced if the child is carried in a stroller or other walker.

Many modern child carriers have features that facilitate the device's immersion in water so that the caregiver can take the child into a body of water such as a swimming pool or the ocean while maintaining secure contact with the child. Such features include the use of waterproof materials and meshing to release any water that may accumulate between the device and either the adult or the child. By giving the carriers the ability to be used effectively in water, the adult can swim or otherwise interact with the child in a manner that is not possible if the adult needs to use her arms to support the child in the water. While such water friendly features give the adult and child enhanced freedoms in a body of water, room exists to give even more water borne freedom and versatility within a body of water.

Therefore, the exists a need in the art for a child carrier wherein the child is held within the carrier and carried about by an adult that dons a harness, which child carrier not only gives the adult maximum freedom in carrying the child about, but also allows the device to be used in a body of water and that gives maximum flexibility and versatility to both child and adult while using the device in the body of water. Ideally, such a child carrier must be of relatively simple design and construction and be easy to use and maintain.

SUMMARY OF THE INVENTION

The child carrier and swimming aid of the present invention addresses the aforementioned needs the art. The child carrier and swimming aid allows a child to be held within the carrier and carried about by an adult in the usual way, giving the adult the various freedoms in so carrying a child. The child carrier and swimming aid can also be used in a body of water giving maximum flexibility and versatility to both child and adult over and on top of the freedoms enjoyed by prior art child carriers that are water friendly. The child carrier and swimming aid is of relatively simple design and construction, relying on standard methods of manufacturing to construct, and is easy to use and maintain.

The child carrier and swimming aid of the present invention is comprised of a harness that is worn by an adult or other appropriate caregiver (older sibling, baby-sitter, etc.), the harness has a belt for extending around a waist of caregiver, the harness also having a pair of straps connected to the belt, the pair of straps passing over shoulders of the caregiver. A vest is worn by a child such that the vest acts as a personal flotation device when worn by the child so that the child floats in a body of water while donning the vest. The vest is removably attached to the harness by at least one quick-disconnect clip, which clip attaches to a back of the vest. A tether connects the harness with the vest. A grab loop may be located on a top of the vest.

BRIEF DESCRIPTION OF THE DRAWINGS

Similar reference numerals refer to similar parts throughout the several views of the drawings.

DESCRIPTION OF THE PREFERRED EMBODIMENT

Figure 1:
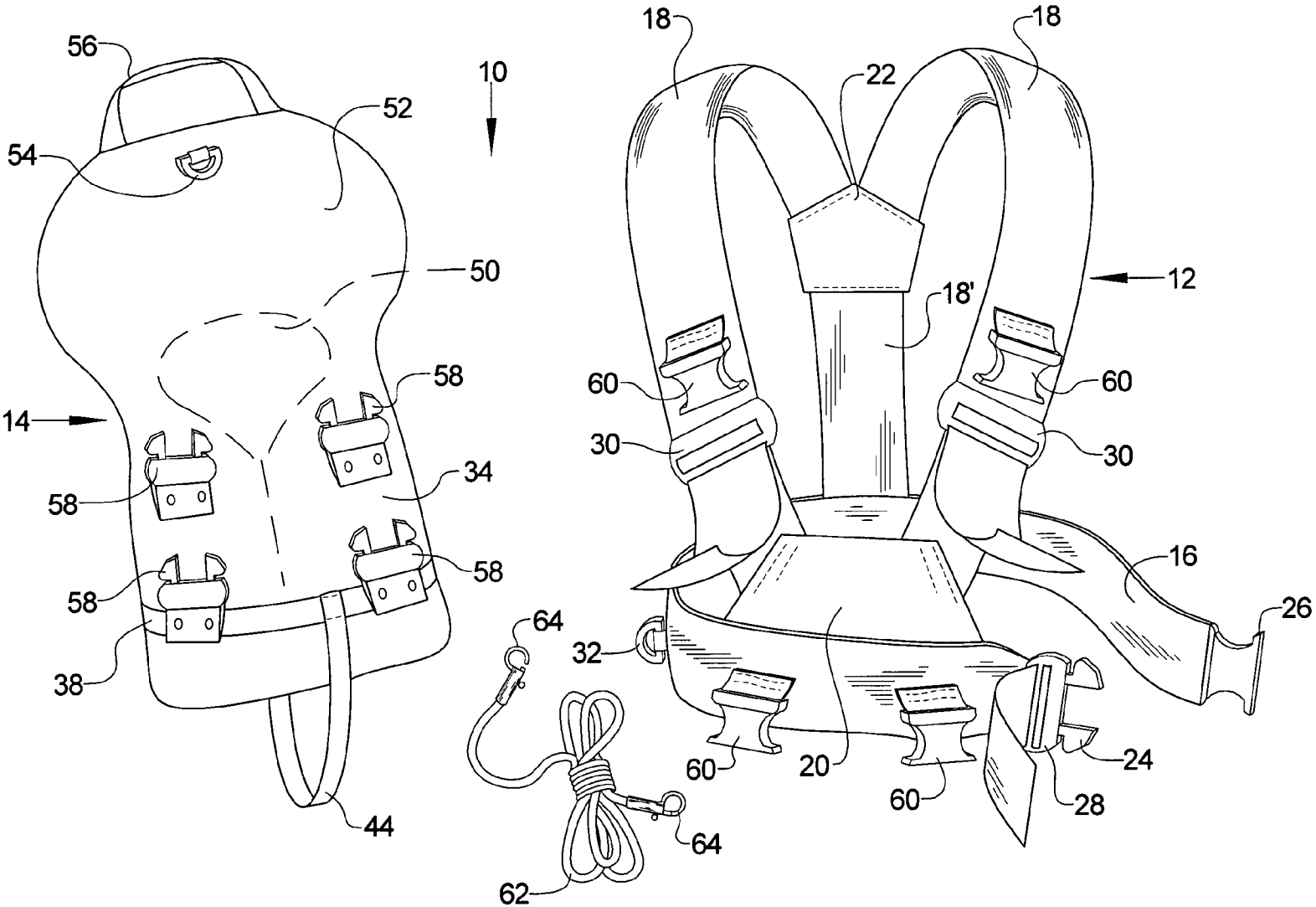
FIG. 1 is a perspective view of the child carrier and swimming aid of the present invention.
Figure 2:
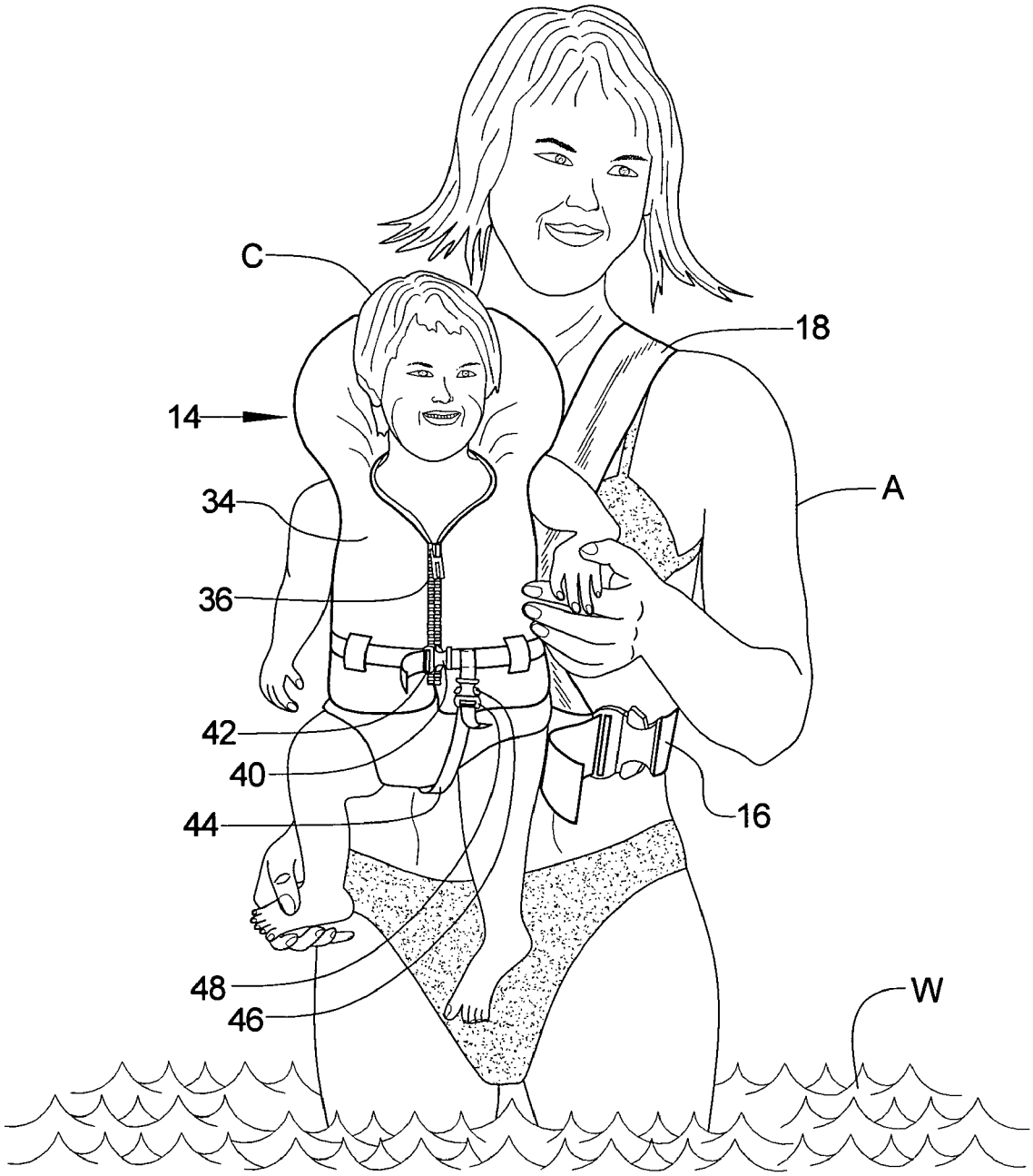
FIG. 2 is a perspective view of the child carrier and swimming aid being used to carry a child.
Figure 3:
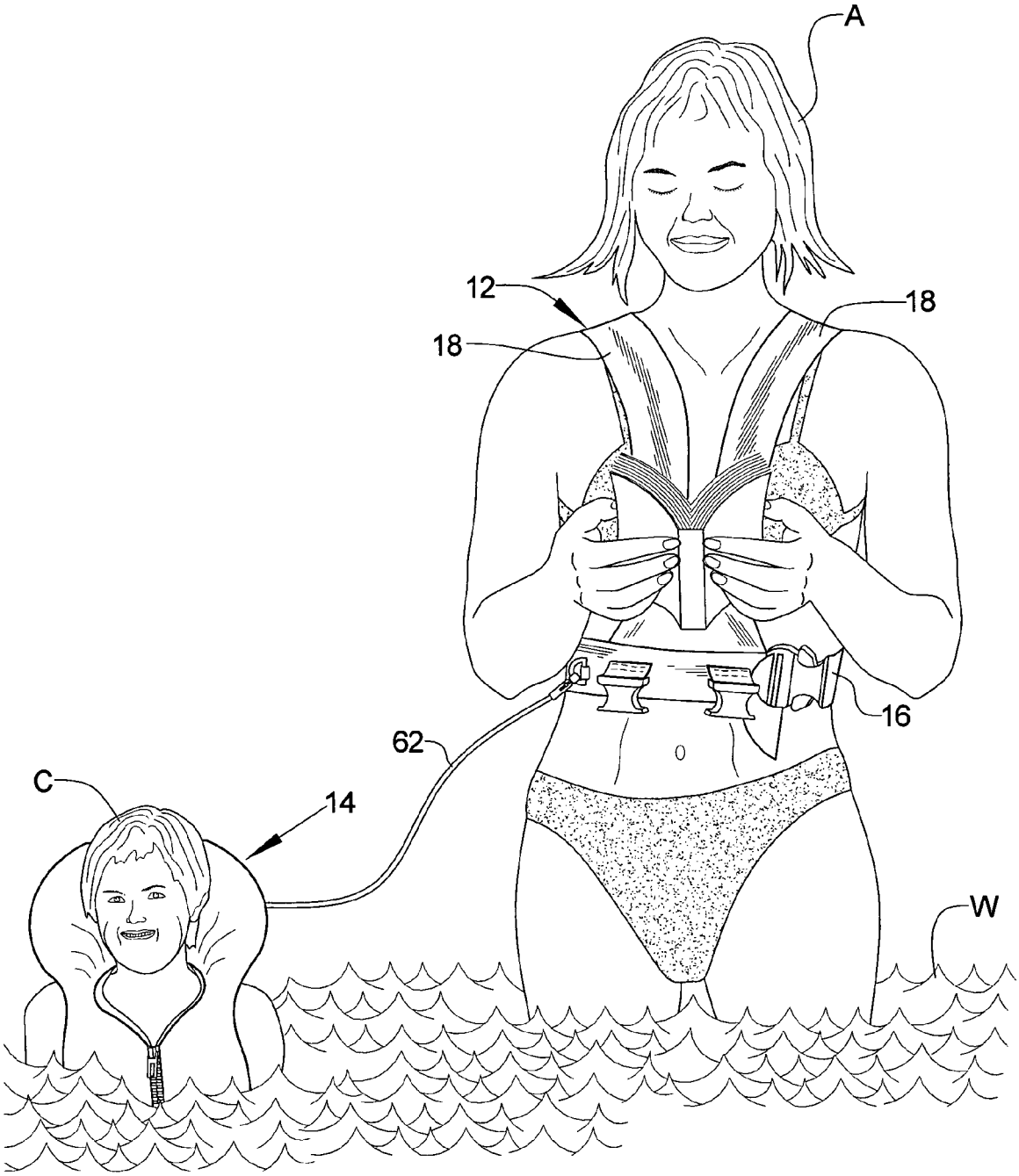
FIG. 3 is a perspective view of the child carrier and swimming aid wherein the child carrying vest is detached from the adult's harness.

Referring now to the drawings, it is seen that the child carrier and swimming aid of the present invention, generally denoted by reference numeral 10, is comprised of a harness 12 and a vest 14. The harness 12 is any appropriate harness that is worn about the torso of a caregiver A such as the illustrated harness 12 which has a belt 16 that extends about the waist of the caregiver A and a pair of straps 18 that attach to the belt 16, either directly, or as illustrated via a stomach patch 20, which may or may not be padded as desired. The straps 18 pass over the shoulders of the caregiver A and attach to the back of the belt 16. The pair of straps 18 may attach directly to the belt 16 at the back of the belt 16, or as illustrated, may meet at a Y-connector, 22, with a single strap 18' extending between the Y-connector 22 and the back portion of the belt 16. The Y-connector 22 may be padded for increased user comfort while wearing the harness 12. The ends of the belt 16 may be connected to each other in appropriate fashion such as using the illustrated quick-disconnect clip of any appropriate design known in the art, which clip has a male portion 24 that is removably received within a female portion 26. An adjustment mechanism 28 is provided on the clip for adjusting the size of the belt 16. Similar size adjustment mechanisms 30 are provided on the shoulder straps 18 for adjusting the length of each of the shoulder straps 18. A D-ring 32 is provided on the harness 12.

The vest 14 is any appropriate vest that acts as a personal flotation device known in the art. The illustrated vest 14 is typical of personal flotation devices for use by children and includes a body member 34 that is split down the middle with the two split portions coming together by providing a zipper 36 on the front of the vest 14. An encircling strap 38 wraps about the vest 14 when worn and uses an appropriate clip 40 to connect its two ends together, the clip 40 having a sizing mechanism 42 thereon. A safety strap 44 extends from the back of the vest 14 and passes between a child's legs and attaches to the encircling strap 38 by an appropriate clip 46, this clip 46 also having a size adjust mechanism 48. The encircling strap clip 40 and the safety strap clip 46 can be of any appropriate design known such as the illustrated quick-disconnect clips. A child's head passes through an opening 50 on the vest 14 such that once through the upper portion 52 of the body member 34 is located behind the child's head and acts as a head rest for the child C. A D-ring 54 is also located on the vest 14 as is a grab loop 56 located on the upper portion 52 of the body member 34. The vest 14 is filled with an appropriate buoyancy material, such as closed cell foam so that a child C wearing the device floats in water. Advantageously, although not necessarily, the vest 14 is approved by the U.S. Coast Guard as a personal flotation device for the specific weight category of the vest 14, and specifically as a near-shore buoyant vest. In such regard the front of the vest 14 is orange in color.

The vest 14 is removably attached to the harness 12 by providing at least one quick-disconnect mating clip and attaching the male portion 58 of the clip on the vest 14 and the female portion 60 on the harness 12 (or vice-versa). In use, the caregiver A dons the harness 12 by passing the belt 16 around her waist and passing the shoulder straps 18 over her shoulders. The belt 16 is closed by receiving the male portion 24 of the belt clip within the female portion 26 of the belt clip. The size of the belt 16 is adjusted using the sizing mechanism 28 on the belt clip. Similarly, the size of each of the shoulder straps 18 is adjusted using their respective sizing mechanisms 30. The vest 14 is placed on the child by placing the child's head through the opening 50. The zipper 36 is zipped closed in order to bring the two halves of the body member 34 together. The encircling strap 38 is encircled about the child C and is closed at the front of the vest 14 by its clip 40. The sizing mechanism 42 is used to adjust the length of the encircling strap 38. The safety strap 44 is brought between the child's legs and is attached to the encircling strap 38 via its clip 46. The sizing mechanism 48 is used to adjust the length of the safety strap 44. The vest 14 is attached to the harness 12 by receiving the male portion 58 of each mating clip within its respective female portion 60 of the mating clip. Once all clips are connected, the vest 14 is attached to the harness 12 and allows the caregiver wearing the harness 12 to carry a child C within the vest 14 in normal child carrying fashion. Sufficient amounts of clips are used in order to be able to bear the load presented by the child C and the vest 14. When a body of water W is entered, the mating clips can be disconnected and a tether 62, having clips 64 on either end, tethers the vest 14 with the harness 12 by having one of the clips 64 attach to the D-ring 32 on the harness 12 while the other clip 64 attaches to the D-ring 54 on the vest 14. The child C can now play in the water W without being firmly attached to the caregiver A. As the vest 14 is a personal flotation device, the child C is kept safely above the water's surface. The tether 62 prevents the child C from straying too far from the caregiver A. If necessary, the caregiver A can pull the child C through the water w or pull the child C out of the water W by grabbing the grab loop 56.

Use of quick-disconnect clips for all clipping functions allows the device 10 to be used in very quick and efficient manner including donning and removal of the harness 12 and the vest 14, vest attachment to and detachment from the harness, and tether 62 attachment and detachment.

While the invention has been particularly shown and described with reference to an embodiment thereof, it will be appreciated by those skilled in the art that various changes in form and detail may be made without departing from the spirit and scope of the invention.

We claim:

1. A carrier comprising:

a harness; and a buoyant vest, removably attached to the harness, wherein the vest acts as a personal flotation device for a wearer and the vest has a body member split down the middle to form two split portions that are removably attachable to one another, the vest further has a back portion that extends between outer sides of each split portion, and an upper portion that extends upwardly from the two split portions and the back portion such that an opening exists between the upper portion and the two split portions whenever the two split portions are attached together and such that the vest is adapted to be worn on a torso of a person such that the two split portions cover a chest of the person, the back portion covers a back of the person, and a head of the person passes through the opening and is positioned against the upper portion and wherein the vest is removably and non-tetherably attached to the harness by at least one quick-disconnect clip and is tetherably attached to the harness by a tether connecting the harness with the vest.

2. The carrier as in claim 1 further comprising a grab loop located on the upper portion of the vest.

* * * * *